United States Patent [19]

Allen et al.

[11] Patent Number: 5,007,558

[45] Date of Patent: Apr. 16, 1991

[54] ORNAMENTALLY-SHAPED, INTERFOLDED PAPER PRODUCTS

[76] Inventors: Joyce Allen, 17671 Rowe, Detroit, Mich. 48205; Kathy M. Bonner, 17679 Rowe, Detroit, Mich. 48205

[21] Appl. No.: 193,570

[22] Filed: May 13, 1988

[51] Int. Cl.[5] ..... B65H 1/00

[52] U.S. Cl. ..... 221/48; 221/24; 221/51

[58] Field of Search ..... 221/48, 49, 50, 51, 221/52, 53, 54, 24, 63; D5/63; 428/43, 57, 80

[56] References Cited

U.S. PATENT DOCUMENTS

| | | | |
|---|---|---|---|
| D. 115,419 | 6/1939 | Munson et al. | 221/48 X |
| 2,580,982 | 1/1952 | Weiss | 221/24 X |
| 2,823,089 | 2/1958 | DeFranco | 221/63 |
| 3,019,940 | 2/1962 | Sutton | 221/48 |
| 3,207,360 | 9/1965 | Scott | 221/48 |
| 3,289,883 | 12/1966 | Bjorklund | 221/48 |
| 3,462,043 | 8/1969 | Frick | 221/48 |
| 4,638,921 | 1/1987 | Sigl et al. | 221/48 X |
| 4,899,905 | 2/1990 | Holtsch | 221/63 |

*Primary Examiner*—Joseph J. Rolla
*Assistant Examiner*—Steve Reiss
*Attorney, Agent, or Firm*—Lynn E. Cargill

[57] ABSTRACT

An ornamentally-shaped, nonrectangular interconnected or interfolded disposable paper product, which includes ornamentally-shaped forms including male protrusions and female indentations. On the interconnected embodiments perforations are located between adjacent and contiguous ornamentally-shaped forms at the points of contiguities. In addition to the paper forms being cut to certain shapes, the perforations finish the definition of the ornamentally-shaped forms which may include such forms as hearts, stars, flowers, beer can motifs, and other such forms. These disposable paper products may include bathroom tissue, paper towels, and pop-up facial tissues and paper napkins.

4 Claims, 1 Drawing Sheet

ORNAMENTALLY-SHAPED, INTERFOLDED PAPER PRODUCTS

TECHNICAL FIELD

The invention disclosed herein relates to disposal paper products, and more particularly to continuous roll sheet material assemblies and interleaved pop-up paper products having ornamental shapes.

BACKGROUND OF THE INVENTION

Conventional disposable paper products have included substantially rectangular sheets of paper in a continuous roll or found in pop-up boxes of interleaved or webbed sheets. Bathroom tissue is commercially available in a roll form in many colors, and has been printed to include decorations for Christmas, bar themes and the like. Furthermore, pop-up tissue boxes are commercially available which dispense substantially rectangular sheets of dyed, printed, embossed and otherwise decorated sheets of disposable tissue.

Heretofore, although such disposable paper products have been available in decorated form, no disposable paper product is being marketed which includes ornamentally-shaped sheets in either a roll configuration or in an interleaved pop-up fashion. It would be advantageous in the production of decorative tissues and toilet paper to provide a product which included ornamentally-shaped forms which were either perforated or interleaved.

U.S. Pat. No. Des. 287,195 issued Dec. 16, 1986 discloses a disposable paper product which includes cloth embossed in heart shapes. Additionally, U.S. Pat. No. 3,462,043 issued on Aug. 19, 1969 to Kimberly-Clark Corporation discloses an interfolded web apparatus and method for substantially rectangular facial tissue sheets.

SUMMARY OF THE INVENTION

According to the invention herein contemplated, there is provided an interconnected disposable paper product including an integral, continuous sheet material assembly made of disposable paper. The paper is cut into ornamentally-shaped, interconnected and perforated forms having male protrusions and complementary female indentations in contiguous forms, such as hearts, stars, beer cans or flowers. The forms have perforations which are located therebetween which define portions of the ornamental shape of the forms, as well as being adapted for easy tearing and separation.

The ornamentally-shaped forms are interconnected by nesting and contacting the male protrusion of a first cut paper form into the complementary female indentation of a second, adjacent, contiguous cut paper form. The perforations are located between and connecting the forms at the points of contiguity. In one embodiment, the sheet material assembly includes upstream and downstream positions, and the ornamentallyshaped forms are oriented substantially identically in their respective positions throughout the entirety of the sheet material assembly. Additionally, the perforations are located in substantially the same place.

Heart-shaped forms in accordance with the present invention may include a pointed end forming the lower surface and two integral hump-like shapes forming the upper surface. They are cut so that the pointed end of an upstream heart-shaped form is nestled between the hump-like shapes of the downstream heart-shaped form.

Perforations are made in the body of the forms to make connections at the points of contact.

Likewise, in the manufacture of star-shaped forms, the top point of a five-point star is nestled into the indentation on the lower surface, and the perforations are located at the points of contact. Furthermore, other ornamental shapes are described in greater detail herein below.

DETAILED DESCRIPTION OF THE DRAWINGS

Figure 1:
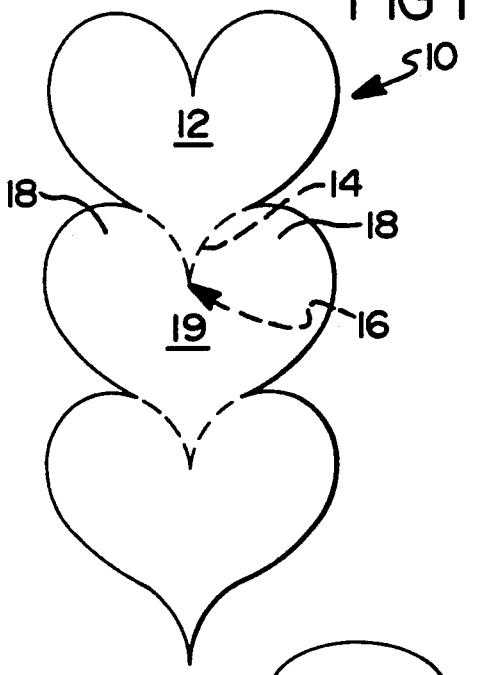
FIG. 1 is an illustration of the heartshaped form in accordance with the present invention, showing the placement of perforations.

Referring to the drawings and particularly to FIG. 1, a sheet material assembly made of cut paper forms is shown generally by the reference numeral 10. More particularly, FIG. 1 shows a heart-shaped form constructed in accordance with the present invention made of heart-shaped forms 12 including perforations 14. Pointed end 16 of the upstream heart-shaped form 12 is nested within the two hump-like shapes 18 forming the upper surface of the downstream heart-shaped form 19. The perforations 14 follow the forms 12 and 19 at the points of contiguity.

As can further be seen in FIG. 1, the sheet material assembly 10 includes upstream and downstream positions, and the heart-shaped forms 12 and 19 are oriented substantially identical in their respective upstream and downstream positions throughout the entirety of the sheet material assembly. Furthermore, perforations 14 are located in substantially the same place throughout the assembly 10.

Figure 2:
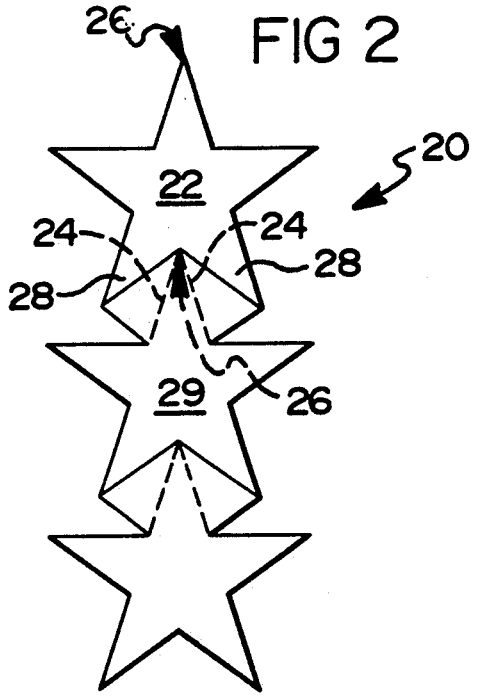
FIG. 2 is an illustration of the star-shaped form in accordance with the present invention, showing the placement of perforations.

Referring now to FIG. 2, an interconnected disposable paper product is shown having a sheet material assembly generally shown as numeral 20 comprised of upstream and downstream star-shaped forms 22 and 29 respectively. The star-shaped forms 22 and 29 have pointed ends 26 which nest in the indentation between the lower two points 28. Perforations 24 are located at the positions of contact.

Figure 3:
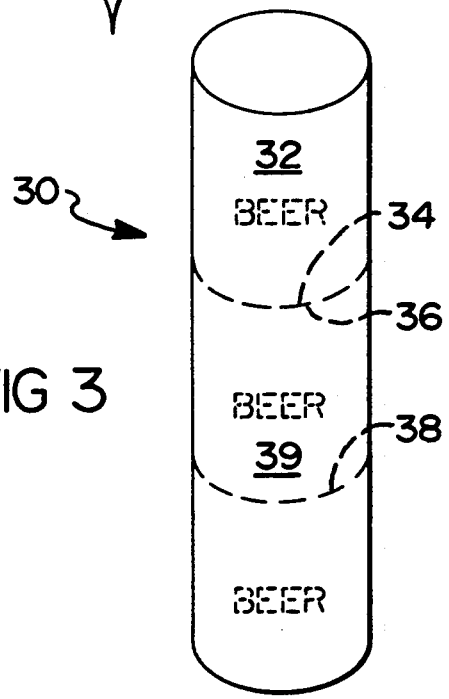
FIG. 3 is an illustration of a beer can motif form, likewise showing the placement of the perforations.

In referring to FIG. 3, yet another embodiment of the present invention is illustrated which follows a beer can motif. The integral, continuous sheet material assembly is generally shown by reference numeral 30. More particularly, FIG. 3 shows a sheet material assembly 30 including beer can shaped forms 32 and 39 respectively having female indentation 36 and complementary male protrusion 38. Perforations 34 are located between the upstream beer can shape form 32 and the downstream beer can shaped form 39 at points of contact to connect the forms as well as to further define the beer can shape.

Figure 4:
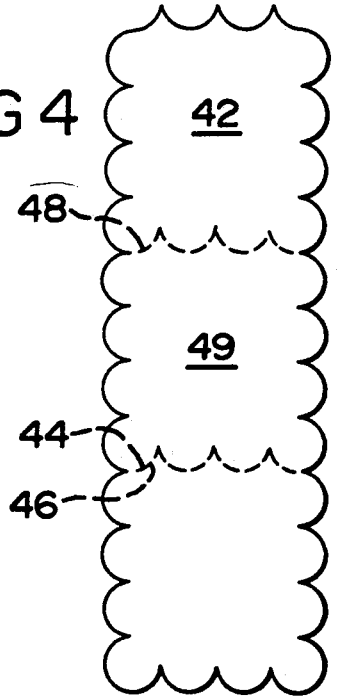
FIG. 4 is an illustration of a form having scalloped -edges, likewise showing the placement of the perforations.

Referring now to FIG. 4, another embodiment of the present invention is shown which follows a scalloped edge form as generally designated by the numeral 40.

The integral, continuous sheet material assembly includes scallop edged forms 42 and 49, respectively having male protrusions 44 and complementary female indentations 46. Perforations 48 are located between the upstream form 42 and the downstream form 49 at points of contact to connect forms 42 and 49 as well as to further define the scalloped edge forms.

Figure 5:
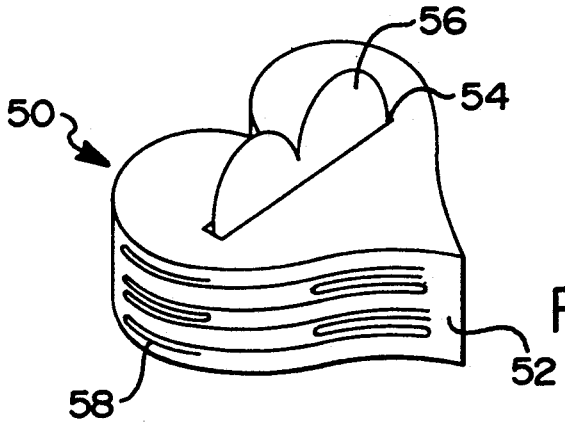
FIG. 5 is a perspective view of a facial tissue box containing interfolded tissues constructed in accordance with the present invention.

In looking now to FIG. 5, a facial tissue dispenser is illustrated generally by the reference numeral 50. Box 52 includes an opening 54 at its top through which ornamentally-shaped tissues 56 may be dispensed. The ornamentally-shaped tissues 56 are interfolded webs 58 including half-web folds in order to be easily dispensed. In addition, box 52 may have a similar shape to the tissue forms themselves. For example, interleaved heart-shaped forms may be dispensed from a heart-shaped box or beer can shaped tissues may be contained in a beer can shaped box. Other conventional methods for folding and interleaving will be obvious to one of ordinary skill in the art.

Numerous other embodiments may include any non-rectangular shape which may be adapted to include an ornamentally-shaped form cut from disposable paper products which have a male protrusion and a female indentation which complement each other and which may further be perforated for interconnection. The preceding discussions and examples are merely meant to be illustrative of some of the features of the instant invention. It is the following claims, including all of its equivalents, which are intended to define the scope of the instant invention.

What is claimed is:

1. A dispenser for interfolded tissue product comprising:

a sheet material assembly of discrete, ornamentally-shaped forms consisting of a non-polygonal perimeter and including at least one curvilinear portion with interfolded webs including half-web folds which are interfolded with themselves and with previous, upstream folded webs, and packed in a box dispenser having a single opening therein for pop-up removal of individual discrete sheets of ornamentally-shaped tissue paper, said box dispenser having a like shape to the shape of the ornamentally-shaped forms contained therein.

2. A dispenser for interfolded tissue product as claimed in claim 1, wherein said discrete shape is a heart-shape.

3. A dispenser for interfolded tissue product as claimed in claim 1, wherein said discrete shape is the shape of a beer can.

4. A dispenser for interfolded tissue product as claimed in claim 1, wherein said forms have scalloped-shaped edges.

* * * * *